United States Patent [19]

Martin et al.

[11] Patent Number: 4,600,602

[45] Date of Patent: Jul. 15, 1986

[54] LOW RESISTANCE RESISTOR COMPOSITIONS

[75] Inventors: Frank W. Martin, Baldwin Place; Samson Shahbazi, Yonkers, both of N.Y.

[73] Assignee: Rohm and Haas Company, Philadelphia, Pa.

[21] Appl. No.: 631,975

[22] Filed: Jul. 18, 1984

[51] Int. Cl.[4] ..... B05D 5/12; H01B 1/06

[52] U.S. Cl. ..... 427/96; 427/282; 427/393.5; 427/393.6; 252/511; 524/495; 524/496

[58] Field of Search ..... 252/511; 524/495, 496; 338/22 R, 25; 428/901; 427/282, 96, 393.5, 396.3

[56] References Cited

U.S. PATENT DOCUMENTS 3,686,139 8/1972 Lubin ..... 252/511

*Primary Examiner*—Josephine L. Barr

*Attorney, Agent, or Firm*—Carl W. Battle; Michael B. Fein; W. E. R. Scott

[57] ABSTRACT

This invention provides unique resistor compositions. These compositions contain solid long chain phenolic resin, liquid short chain phenolic resin and a mixture of carbon black and graphite particles dispersed therein. The combination of these elements allows for resistor compositions that are capable of withstanding high humidity conditions without significant changes in resistivity and which are capable of low ohmic values in the absence of metals. Also provided is a method of producing these compositions.

16 Claims, No Drawings

LOW RESISTANCE RESISTOR COMPOSITIONS

BACKGROUND OF THE INVENTION

1. Field of the Invention

This invention relates to resistor compositions. More specifically this invention relates to resistor compositions made of organic resin with a mixture of carbon black and graphite particles dispersed therein. Even more specifically this invention relates to resistor compositions that contain liquid short chain phenolic resin, solid long chain phenolic resin and a mixture of carbon black and graphite particles dispersed therein.

2. Description of the Prior Art

Resistor elements which comprise a dispersion of finely divided conductive particles in a solid dielectric such as, for example, a polymerized resin, are well known in the prior art. Generally, these resistors comprise a dispersion of finely divided carbon or metal particles in a solid resinous material which may additionally contain various organic or inorganic filler materials. The resins that are used in the production of such resistors may be of either a thermosetting or thermoplastic nature depending upon the specific requirement of a particular installation. Natural resins as well as synthetic resins such as phenolic condensation products, alkyl resins, vinyl resins have been used in the manufacture of resistors.

Many different heat curable polymeric materials have been used to produce resistive coatings. Among those most commonly used are phenol-formaldehyde condensates and difunctional epoxy resins.

U.S. Pat. No. 3,056,750 discloses a resistor comprising discrete units dispersed in one or more solid resinous dielectric materials. Each one of these discrete units in turn comprises an aggregate of conductive particles which have been precoated, at least in part, with one or more dielectric materials which subsequently may be polymerized so as to bind the individual conductive particles together to form the aggregate or unit.

U.S. Pat. No. 3,328,317 discloses resistor compositions that combine phenolic resins and silicone resins to form dielectric binders.

U.S. Pat. No. 3,686,139 discloses an electrically resistive composition which comprises an admixture of a selected heat curable polymeric material and conductive particles. These selected polymeric materials include mixtures of trifunctional epoxy resin and phenolic resin; mixtures of phenolic resin, melamine resin, and precursors thereof, and epoxy-modified phenolic resin; mixtures of epoxy modified phenolic resin, phenolic resin, and epoxy resin and melamine resins.

U.S. patent application Ser. No. 556,840 filed on Sept. 30, 1983, now abandoned by Electro Materials Corporation of America discloses resistor compositions. Specifically it discloses resistor compositions comprising carbon particles embedded in a matrix formed from short chain-length phenolic resin, long chain-length phenolic resin and epoxy. Also disclosed are resistor composition comprising carbon particles embedded in a matrix formed from short chain-length phenolic resin, long chain-length phenolic resin, epoxy and a filler. The resistor composition may be formulated as either a low, medium or a high resistance resistor compositions depending on the type and proportion of carbon material and phenolic resin employed in addition to whether or not filler is present.

In electrical and electronic circuits, it is highly desirable that the electrical values of the various circuit components remain constant within close limits, despite wide changes in such operating conditions as the humidity and temperature which the device may encounter in use. Changes in resistance may cause malfunction of the circuit.

The prior art compositions are deficient in that they are succeptible to changes in resistivity under conditions of changing relative humidity. Furthermore, it has not been possible to produce a resistor composition that is capable of low ohmic values without metal being a component of the resistor composition.

It has been a long sought goal to provide resistor compositions that are reliable under a wide variety of working conditions, such as, for example, conditions of high relative humidity, and to provide low resistance resistors without resorting to the use of metals. Low resistance resistors are currently available; however, these compositions contain precious metals and as such are expensive.

SUMMARY OF THE INVENTION

It is therefore an object of the invention to provide novel resistor compositions that are capable of withstanding high humidity conditions without any significant change in resistivity.

It is another object of the invention to provide low resistance resistor compositions that do not contain metal.

A further object is to provide resistor compositions that do not contain metal and which are capable of low ohmic values. Another object is to provide a method for preparing resistor compositions.

Yet another object is to provide for articles of manufacture produced utilizing the composition of the instant invention.

These objects and others will become apparent, are achieved by the present invention, which comprises, in one aspect, a resistor composition capable of withstanding high humidity conditions comprising (A) a resin system comprising (i) liquid short chain phenolic resin; (ii) solid long chain phenolic resin; and (B) a mixture of (i) carbon black and (ii) graphite particles dispersed is said resin system. Another aspect of the invention is a method of making a resistor composition comprising:

(i) dissolving solid long chain phenolic resin in solvent to form a solution;

(ii) mixing said solution with liquid short chain phenolic resin;

(iii) dispersing a mixture of carbon black and graphite particles in the solution to form a mixture;

(iv) applying the mixture to a substrate;

(v) curing the mixture.

DETAILED DESCRIPTION OF THE INVENTION

The resistor coating compositions of the instant invention contain finely divided electrically conductive particles dispersed throughout a substantially non-conductive heat curable polymeric vehicle. The polymeric vehicle must adhere to the dielectric substrate during the application operation and provide a hard solid matrix in which the conductive particles will remain dispersed after curing at elevated temperatures.

The resistor composition of the present invention comprises (A) a resin system comprising (i) liquid short chain phenolic resin; (ii) solid long chain phenolic resin;

and (B) a mixture of (i) carbon black and (ii) graphite particles dispersed in said resin system.

The resin system comprising the liquid short chain and solid long chain phenolic resins must be a one step heat reactive system; that is, the resin system must be stable at room temperature but readily crosslink upon the application of heat. In contrast to this, there are two step novolac phenolic resin systems which must be prereacted before the system is capable of being crosslinked. Such a system cannot be used to formulate compositions of the instant invention. Typically, these two stage novolac resin systems have a number average molecular weight of greater than 500.

The liquid short chain phenolic resin employed in the instant invention may be a phenol-formaldehyde resin such as that sold by Clark Chemical Corporation under the designation CR 3558. Another suitable liquid short chain phenolic resin is that sold by Union Carbide Corporation under the designation BKR 2620. The liquid short chain phenolic resin preferably makes up to 1% to 20%, by weight, before cure of each of the resistor compositions. This short chain phenolic resin must be a liquid at room temperature and the number average molecular weight of the resin must be in the range of about 300 to about 400.

The solid long chain phenolic resin may be a phenol-formaldehyde resin such as sold by the Union Carbide Corporation under the designation BLS 2700. Another solid long chain phenolic resin is that sold by Reichhold Chemical, Inc. under the designation VARCUM 29-112. This phenolic resin is a solid at room temperature. The solid long chain phenolic resin preferably makes up 30% to 50%, by weight, before cure of each of the resistor compositions. The number average molecular weight of this resin must be in the range of from about 400 to about 500.

It is important that the weight ratio of liquid short chain phenolic resin to solid long chain phenolic resin be from about 1:1 to about 100:1. Preferably the weight ratio is from about 2:1 to about 3:1. Additionally the weight ratio of the resin system to the mixture of carbon black and graphite particles must be from about 85:15 to about 50:50 in order for the composition to perform adequately. Preferably the weight ratio is from about 82:18 to about 78:22.

The resin system and the carbon black-graphite mixture are prepared separately and then mixed together by any conventional means.

The resin system may be prepared by first crushing the solid long chain phenolic resin into a fine powder. This crushed resin is then mixed and blended with solvent, typically butyl Carbitol® acetate, until a lump free solution is achieved. Butyl Carbitol® acetate is an ester solvent sold by Union Carbide. The liquid short chain phenolic resin can then be added and blended into the mixture. The resin system should have a Brookfield viscosity of between about 500 cps and 1750 cps, measured using a Brookfield RVT Viscometer with a T.A. spindle. Preferably, the viscosity should be between about 800 and about 1300. If the vicosity is too high it can be lowered by the addition of solvent in about 0.5% increments.

The mixture of carbon black and graphite particles employed must conform to certain specifications in order for the compositions to function according to as hereinbefore described. It is understood that any type of carbon black or graphite may be used as long as the specifications indicated are met. It is thought that the combination of using very fine particle sizes with very high surface areas are what gives the compositions of the instant invention their unique characteristics. We have used a highly conductive carbon black sold by Noury Chemical Corporation and designated Ketjenblack®EC. Ketjenblack®EC is a highly electrically conductive non-reinforcing furnace type carbon black.

The carbon black should have a particle size distribution of from about 10 millimicrons to about 100 millimicrons, whereas the particle size distribution for the graphite should be from about 1 micron to about 10 microns. Accordingly, the average particle size of the mixture of carbon black and graphite particles is from about 1 micron to about 10 microns. It is important to understand that this range refers to the particle size distribution of the carbon black-graphite mixture before it is combined with the resin system; that is, immediately after the mixture has been ball milled.

Considering this particle size distribution, the surface area of the carbon black should be from about 500 to about 1500 $m^2/g$ and the surface area of the graphite should be from about 1 to about 2 $m^2/g$. Therefore, the ratio of the surface area of carbon black to graphite is from about 500:1 to about 1500:1.

In the broadest sense, the weight ratio of carbon black to graphite that may be used is from about 10:90 to about 50:50.

Any conventional method may be employed to grind the carbon black and graphite to the required specifications. We have used a procedure called ball milling. Essentially the mixture of carbon black and graphite particles is prepared using varying proportions of each element depending upon the desired resistivity of the final composition. The carbon black and graphite particles are placed in a 2 gallon ball mill which has been ½ filled with ½" diameter Burundum balls. The ball mill is then filled to within two inches of its orifice with liquid freon. After milling the fineness of grind of the resultant composition can be determined. As indicated, at this stage in the preparation of the composition, the fineness of grind should be from about 1 to about 10 microns. The total milling time to achieve this fineness of grind should never be more than two hours. After milling is complete the freon must be removed, typically by distillation.

Fineness of grind may be measured by any standard technique. We have used a procedure whereby a sample of dried, ground powder is removed from the ball mill and mixed with a polymeric vehicle. Fineness of grind is then checked with a standard fineness of grind gauge. The polymeric vehicle we employed was based on ethyl cellulose and has the following compositional make-up: 47.2% decyl alcohol, 21% ethyl cellulose, 30% butyl Carbitol® acetate and 1.8% Stabilite®.

The resin system and the mixture of carbon black and graphite particles can be mixed together by any conventional means as long as the powders are thoroughly wetted and dispersed. After this mixing, the dispersion is passed through a 3 roll mill which rollers have been tightened to 100 psi. After the pass through the 3 roll mill, the fineness of grind is checked. More passes through the 3 roll mill must be made if the fineness of grind of the dispersion at this point is not 7 microns or less. In order to get maximum electrical properties, this fineness of grind must be achieved. The composition so produced has an ohmic value of between 18–150 ohms/sq/micron cured. If the resistance is greater than 150 ohms/sq/mil ball milling should be continued for an additional time period. However, in no event should the mixture be ball milled for more than three hours.

The composition of the instant invention conforming to the beforementioned specifications are capable of low ohmic values without any metal being present in the composition. By low ohmic values we mean values lower than 150 ohms/sq/mil preferably between 18 and 120 ohms/sq/mil, most preferably between 20 and 100 ohms/sq/mil. The resistance of the composition can be changed by varying the amounts used of carbon black and graphite and the liquid short chain and solid long chain phenolic resins.

The compositions of this invention formulated according to the above mention specifications are capable of withstanding high humidity conditions without displaying significant changes in resistivity. This represents a tremendous advantage over the prior art compositions. Tolerance levels of as much as ±10–20% are allowed with resistor compositions applied to printed circuit boards. The instant compositions are reliable to ±1.0% of their original resistivity value after being subjected to high humidity conditions. Changes in resistivity were measured under conditions of 85° C. at 85% and 90% relative humidity for 250 hours.

In accordance with the present invention the compositions are made by dissolving a solid long chain phenolic resin in solvent to form a solution, mixing said solution with liquid short chain of phenolic resin, dispersing a mixture of carbon black and graphite particles in the solution to form a mixture, applying the mixture to a substrate and then curing the mixture. Any solvent capable of dissolving the solid long chain phenolic resin may be employed. The mixture so formed is often referred to as an ink. This mixture or ink can be applied to a substrate by a variety of methods such as, for example, screen printing. Before application, however, the composition must be checked for fineness of grind. The fineness of grind should be less than 7 microns. If the proper fineness of grind has not been obtained, the composition should be passed through a 3 roll mill set at 100 p.s.i. pressure until the required fineness is obtained. The mixture when applied to the substrate must be cured. This is accomplished by baking the mixture in an oven for about 60 to about 120 minutes at temperatures of from about 150° C. to about 165° C. The composition adheres well to the substrate and is ready for use.

EXAMPLES

EXAMPLE I

Method of Making Resin System

Solid long chain phenolic resin supplied by Union Carbide and designated B.K.R. 2620 and having a number average molecular weight of 500 was crushed into a fine powder using a mortar and petle. This resin was then placed in a stainless steel mixing bowl and blended with butyl Carbitol® acetate solvent until a clear lump-free solution was achieved. Liquid short chain phenolic resin supplied by Union Carbide and designated B.L.S. 2700 and having a number average molecular weight of 300 was then added to the solution and the total mixture blended for two hours.

The total formulation of this mixture was as follows:

| | |
|---|---|
| Butyl Carbitol ® acetate | 41.66% |
| Solid Long chain phenolic resin | 41.66% |

-continued

| | |
|---|---|
| Liquid Short chain phenolic resin | 16.68% |

The resultant mixture was allowed to cool to 25° C. The viscosity was measured using a Brookfield R.V.T. Viscometer with a TA spindle and found to be 1000 cps.

EXAMPLE II

Preparation of the Mixture of Carbon Black and Graphite Particles

A mixture of carbon black and graphite particles were prepared by mixing 800 grams of graphite powder with 200 grams of Ketjenblack ®EC powder. Ketjenblack ®EC powder is a highly conductive carbon black supplied by Noury Chemical Corporation of New York. A two gallon ball mill was half filled with half inch diameter Burundum balls. The mixture of carbon black and graphite particles was then placed in the ball mill. The ball mill was then filled to within two inches of its orifice with liquid freon. The mixture was then ball milled for one hour. The mixture was then removed from the ball mill and placed in a stainless steel pot for 24 hours to evaporate the liquid freon. The fineness of grain of the resulting composition was found to be 8 microns.

EXAMPLE III

Method of Making Resistor Composition [100 ohms]

40 grams of the resin system of Example I was hand mixed with 10 grams of the mixture of carbon black and graphite particles of Example II until the powders were thoroughly wetted and dispersed.

The mixture was contact milled four times at 100 p.s.i. and fineness of grind was checked and found to be 6 microns.

The resistance of the composition was 100 ohms/sq-/mil.

EXAMPLE IV

Resistor Composition [50 ohms]

40 grams Ketjenblack ®EC powder and 60 grams graphite was ball milled according to Example II.

Fineness of grind was found to be 6 microns.

77 grams of the resin system of Example I was mixed with 23 grams of this Ketjenblack ® graphite mixture.

The composition was passed through a 3 roll mill until the fineness of grind was 6 microns. The composition was applied to a printed circuit board by silk screening and then dried and cured at 165° C. for 60 minutes.

The resistance of the composition was 50 ohms/sq-/mil.

EXAMPLE V

Resistor Composition [30 ohms]

A resistor composition was prepared as described in Example IV, except that 69.1 grams of the resin system of Example I was hand mixed with 31.9% of the Ketjenblack ®EC-graphite mixture.

The composition was passed through a 3 roll mill until the fineness of grind was 6 microns. The composition was then applied to a printed circuit board by silk screening and then dried and cured at 165° C. for 60 minutes.

The resistance of the composition was 30 ohms/sq-/micron.

EXAMPLE VI

Resistor Composition [18 ohms]

A resistor composition was prepared as in Example IV except that 35 grams of the resin system of Example I was mixed with 30 grams of the Ketjenblack ®EC powder-graphite mixture and 35 grams of butyl Carbitol ® acetate. The composition was applied to a printed circuit board using a doctor blade.

The resistance of the composition was found to be 18 ohms/sq/mil.

We claim:

1. A resistor composition capable of withstanding high humidity conditions comprising:

(A) a resin system comprising (i) liquid short chain phenolic resin having a number average molecular weight of from about 300 to about 400;

(ii) solid long chain phenolic resin having a number average molecular weight from about 400 to about 500; and (B) a mixture of (i) carbon black having a surface area of from about 500 $m^2/g$ to about 1500 $m^2/g$; and (ii) graphite particles dispersed in said resin system, said composition having an electrical resistance of from about 18 to about 150 ohms/sq./mil.

2. The composition of claim 1 wherein the ratio of (A) to (B) is from about 85:15 to about 50:50.

3. The composition of claim 1 wherein the ratio of carbon black to graphite is from about 10:90 to about 50:50.

4. The composition of claim 1 wherein the ratio of liquid short chain phenolic resin to solid long chain phenolic resin is from about 1:1 to about 100:1.

5. The composition of claim 1 wherein the carbon black has a particle size of from about 10 millimicrons to 100 millimicrons.

6. The composition of claim 1 wherein the graphite has a particle size of from about 1 micron to about 10 microns.

7. The composition of claim 1 wherein the average particle size of the carbon black-graphite mixture is from about 1 micron to about 10 microns.

8. The composition of claim 1 wherein the surface area of the graphite is from about 1 $m^2/g$ to about 2 $m^2/g$.

9. The composition of claim 1 wherein the ratio of the surface area of carbon black to graphite is from about 500:1 to about 1500:1.

10. The composition of claim 1 wherein the resin system is a one step heat reactive phenolic resin system.

11. The composition of claim 1 wherein the fineness of grind is between about 1 micron to about 7 microns.

12. The composition of claim 1 wherein the ohmic value varies less than ±1.0% at 85% relative humidity.

13. A method of making a resistor composition of claim 1 comprising:

(i) dissolving solid long chain phenolic resin in solvent to form a solution;

(ii) mixing said solution with liquid short chain phenolic resin;

(iii) dispersing a mixture of carbon black and graphite particles in the solution to form a mixture;

(iv) applying the mixture to a substrate;

(v) curing the mixture.

14. The method of claim 13 wherein the mixture is cured at a temperature of from about 150° C. to 165° C. from about 60 to about 120 minutes.

15. The method of claim 13 wherein the mixture is applied to a substrate by silk screening.

16. The composition of claim 1 wherein the resistance value varies less than about ±1.0% when the relative humidity varies from about 80% to about 90% at 85° C.

* * * * *

UNITED STATES PATENT AND TRADEMARK OFFICE

CERTIFICATE OF CORRECTION

PATENT NO. : 4,600,602

DATED : July 15, 1986

INVENTOR(S) : Frank W. Martin and Samson Shahbazi

It is certified that error appears in the above-identified patent and that said Letters Patent is hereby corrected as shown below:

Please amend claim 5 to read as follows, "The composition of claim 1 wherein the carbon black has a particle size of from about 10 millimicrons to about 100 millimicrons".

Signed and Sealed this

Seventeenth Day of March, 1987

*Attest:*

DONALD J. QUIGG

*Attesting Officer*

*Commissioner of Patents and Trademarks*